US006239763B1

(12) United States Patent
Cuchanski

(10) Patent No.: US 6,239,763 B1
(45) Date of Patent: May 29, 2001

(54) APPARATUS AND METHOD FOR RECONFIGURING ANTENNA CONTOURED BEAMS BY SWITCHING BETWEEN SHAPED-SURFACE SUBREFLECTORS

(75) Inventor: Michael Cuchanski, Newtown, PA (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 09/342,267

(22) Filed: Jun. 29, 1999

(51) Int. Cl.[7] ..... H01Q 19/10
(52) U.S. Cl. ..... 343/781 P; 343/781 CA
(58) Field of Search ..... 343/781 P, 781 CA, 343/781 R, 837; H01Q 19/10

(56) References Cited

U.S. PATENT DOCUMENTS 4,260,993 * 4/1981 Aubry et al. ..... 343/779
4,535,338 * 8/1985 Ohm ..... 343/781 CA
5,444,455 * 8/1995 Louzir et al. ..... 343/895
5,485,168 * 1/1996 Parekh ..... 343/761
5,526,008 * 6/1996 Meserole et al. ..... 343/761

* cited by examiner

*Primary Examiner*—Hoanganh Le
(74) *Attorney, Agent, or Firm*—Swidler Berlin Shereff Friedman, LLP

(57) ABSTRACT

A configurable antenna includes a main reflector and at least two subreflectors. Each of the subreflectors is configurably disposed relative to the main reflector to provide an active subreflector for reflecting radiation between the main reflector and a point off of the main reflector in a desired beam pattern. Each subreflector typically has a different shape and may be moved into the active subreflector position to produce a desired beam pattern during operation of the antenna. The antenna further includes a horn disposed at a point off of the main reflector for feeding signals to the reflectors and for receiving signals from the reflectors. The configurable antenna is typically mounted on a satellite system which itself, or in response to instructions or commands from a ground station, reconfigures the antenna to provide the desired beam shape.

17 Claims, 7 Drawing Sheets

APPARATUS AND METHOD FOR RECONFIGURING ANTENNA CONTOURED BEAMS BY SWITCHING BETWEEN SHAPED-SURFACE SUBREFLECTORS

FIELD OF THE INVENTION

The present invention relates generally to antennas and beam forming and more particularly to techniques for dynamically reconfiguring antenna contoured beams by switching between shaped-surface subreflectors.

BACKGROUND OF THE INVENTION

Antennas are designed to project beams of a certain shape for both transmitting and receiving radio waves. For example, geo-stationary satellite mounted antennas may be configured to project a beam that is roughly the shape of a geographic region, such as a state within the United States. Thus, the satellite antenna is configured to transmit radio waves to and receive radio waves from the geographic region on the earth's surface defined by the beam.

From time to time it may be desirable to change the shape of the beam that a given antenna transmits and receives in. The change may be necessitated by a change in the geographic distribution of demand for a communications service provided via the antenna, by a need to transfer the satellite to a different orbital location, or by a need to respond to an emergency. When the antenna is mounted on a satellite, there is no economically feasible way to retrieve and reconfigure the antenna. Therefore, it would be desirable to provide dynamically configurable antennas that are capable of being reconfigured to form beams of different shapes from a remote location.

There are at least two conventional techniques for reconfiguring the shape of a beam produced by an antenna. In the first technique, an array of horns is configured to transmit/receive via a reflector. In the case of transmission, for example, by varying the amplitude and phase excitation of each horn in the array of horns, the beam shape may be changed to a desired shape.

In the second technique a single or multiple horns are configured to transmit and receive via a reflector. The reflector is either shaped or unshaped. In its unshaped configuration, the reflector is a paraboloid. In its shaped configuration, the reflector may be shaped to reflect radio waves to produce the desired shape. To make the antenna configurable, the reflector is made deformable and includes motors or servos coupled to its non-reflective side. The motors or servos may be commanded to urge the reflector into different shapes thus producing a corresponding change in shape of the transmitted and received beams.

Each of these conventional techniques has disadvantages. In the case of the array of horns, the array is heavy which may add substantially to launch costs in the case of a satellite based antenna. The array of horns also takes up a substantial amount of space compared to other antenna configurations, particularly where 100 or more horns are required for the array. Available space on a satellite for mounting apparati is scarce, particularly as a goal of satellite design is miniaturization. Therefore, this conventional technique may not be practical for many if not most satellite communication applications.

In the case of using motors or servos to urge a reflector into different shapes to produce a corresponding change in beam shape, this technique is clumsy. Moreover, it may be expensive, inaccurate, heavy by comparison to other antenna configurations and prone to failure.

It would be desirable to provide a new technique for remotely reconfiguring an antenna to form beams of different shapes. It would further be desirable for the new technique to be inexpensive, light weight and take up correspondingly less space on a satellite than conventional techniques.

SUMMARY OF THE INVENTION

According to the present invention, a method and apparatus provide an antenna that is remotely configurable to change the shape of a beam associated with the antenna.

The configurable antenna includes a main reflector and at least two subreflectors. Each of the subreflectors is configurably disposed relative to the main reflector to provide an active subreflector for reflecting radiation between the main reflector and a point off of the main reflector in a desired beam pattern. Each subreflector typically has a different shape and may be moved into the active subreflector position to produce a desired beam pattern during operation of the antenna.

The antenna further includes a feed element such as a horn, helix, dipole, microstrip or a small array of similar feed elements disposed at a point off of the main reflector for feeding signals to the reflectors and for receiving signals from the reflectors. The configurable antenna is typically mounted on a satellite system which itself, or in response to instructions or commands from a ground station, reconfigures the antenna to provide the desired beam shape.

BRIEF DESCRIPTION OF THE FIGURES

The above described objects, features and advantages will be more fully understood with reference to the detailed description and appended figures, where.

DETAILED DESCRIPTION

Figure 1:
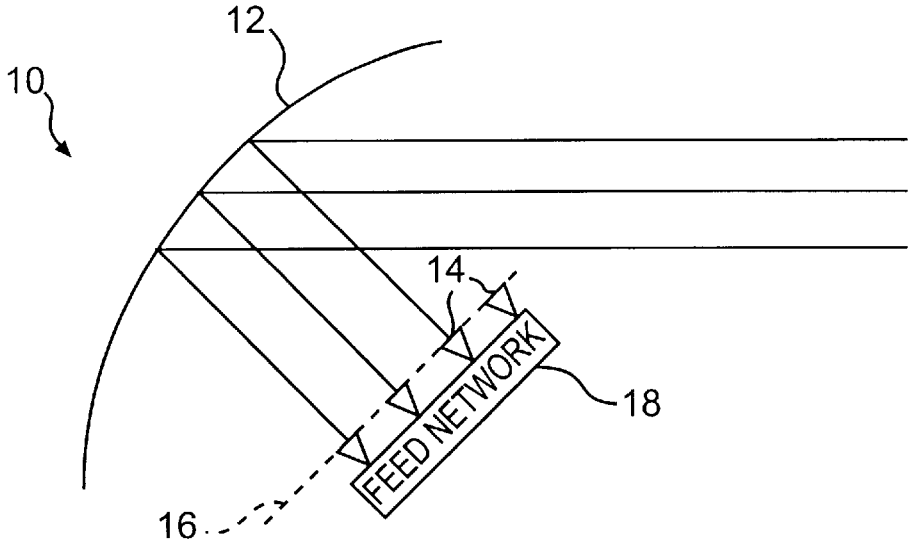
FIG. 1 (PRIOR ART)
FIG. 1 depicts a configurable antenna using an array of feed horns according to the prior art.

FIG. 1 depicts an arrangement of an antenna 10 according to the prior art for generating a configurable beam. The antenna 10 includes a main reflector 12, an array of horns 14, a feed network 18 and a transponder 20. The transponder 20 generates signals for transmission via the antenna 10 and also receives signals from the antenna 10. The transponder is coupled to the feed network 18. The feed network 18 in turn is coupled to an array of horns 14 which are generally arranged along a feed plane 16. The horns 14 are waveguides that project signals received from the feed network 18 onto the main reflector 12. The feed network 18 is configurable and may be configured to change the amplitude and phase excitation of individual horns 14 within the array of horns. By changing the amplitude and phase excitation of each horn 14 in delivering signals from the transponder 20, the shape of a beam carrying the transmitted signals also is changed. The beam issuing forth from the array of horns 14 then reflects off of the main reflector 12 toward a target. The beam is thus projected at the target and may be changed by changing the amplitude and phase excitation of the feed network.

Although configurable, the antenna 10 has several disadvantages. Most notably, the array of feed horns 14 is heavy and takes up a substantial amount of space on the satellite as compared to other antenna configurations. This is particularly problematic where the array must include more than 50 to 100 horns 14. A reconfigurable feed network is complex, expensive, and may have to include redundant elements to ensure reliable operation.

Figure 2:
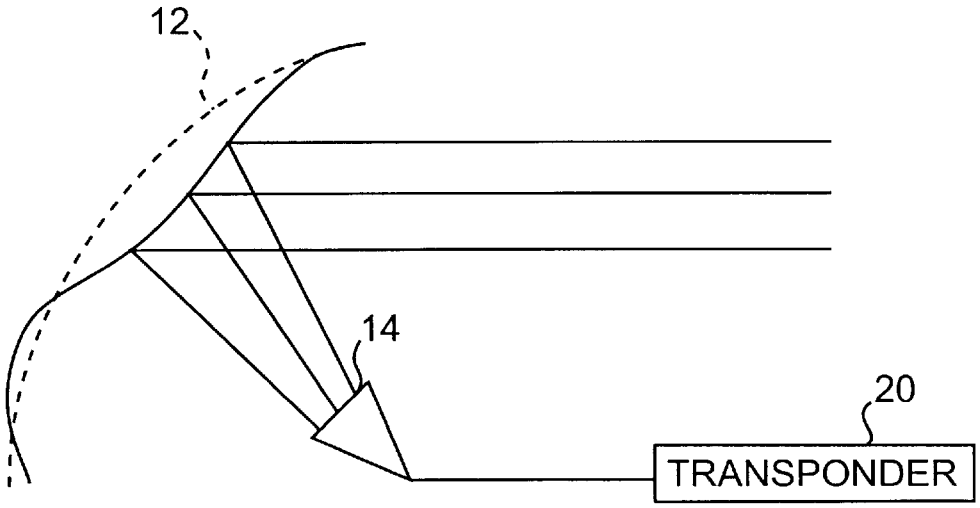
FIG. 2 (PRIOR ART)
FIG. 2 depicts a configurable antenna using a deformable reflector according to the prior art.

FIG. 2 depicts an alternate scheme for shaping beams issuing from an antenna 10. According to this scheme, the main reflector 12 is deformable under urging by motors or servos (not shown). The deformation is, in theory, controlled to produce different desired beam shapes. The main reflector may be used with a single horn 14 and transponder 20, without the need for an elaborate feed network to excite an array. This technique may be clumsy and inaccurate for several reasons. First, the surface deformation of the main reflector must be elastic (fully recoverable to initial state). Therefore, the range and rate of surface modification is severely limited. Second, a mesh material may have to be used, which restricts polarization and/or frequency of the signal. Third, the motors or servos require a sturdy mounting structure and a control network which may require a lot of space.

Figure 3:
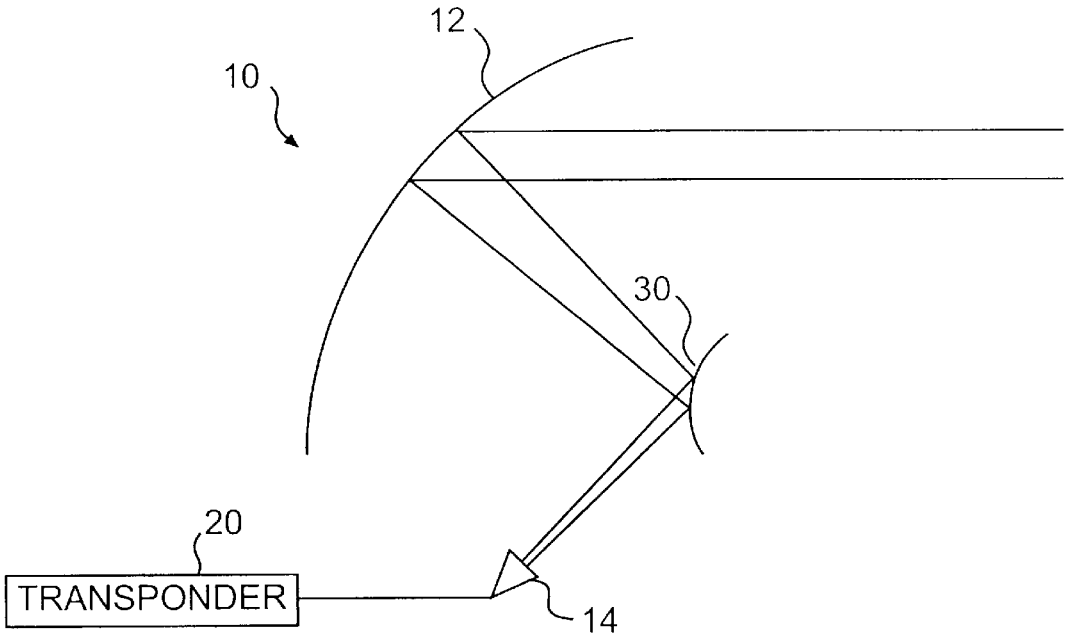
FIG. 3 (PRIOR ART)
FIG. 3 depicts an unconfigurable, dual-reflector antenna according to the prior art.

FIG. 3 depicts a fixed beam shape, dual reflector antenna 10 according to the prior art. The antenna 10 includes a main reflector, a subreflector 30, a horn 14 and a transponder 20. During a transmit operation, the transponder 20 transmits a signal via the horn 14 to the subreflector 30. The subreflector reflects the signal from the horn to the main reflector where the signal emanates as a transmitted beam toward a target. During a receive operation, the main reflector 12 receives incident radiation from a field of view. Only incident radiation that is within a receive beam shape will then be reflected from the main reflector 12, off of the subreflector 30 toward a communicating end of the horn 14. The transponder in turn receives the signal from another communicating end of the horn 14. The subreflector 30 is an ellipsoid for Gregorian optics and a hyperboloid for Cassegrain optics.

Figure 4:
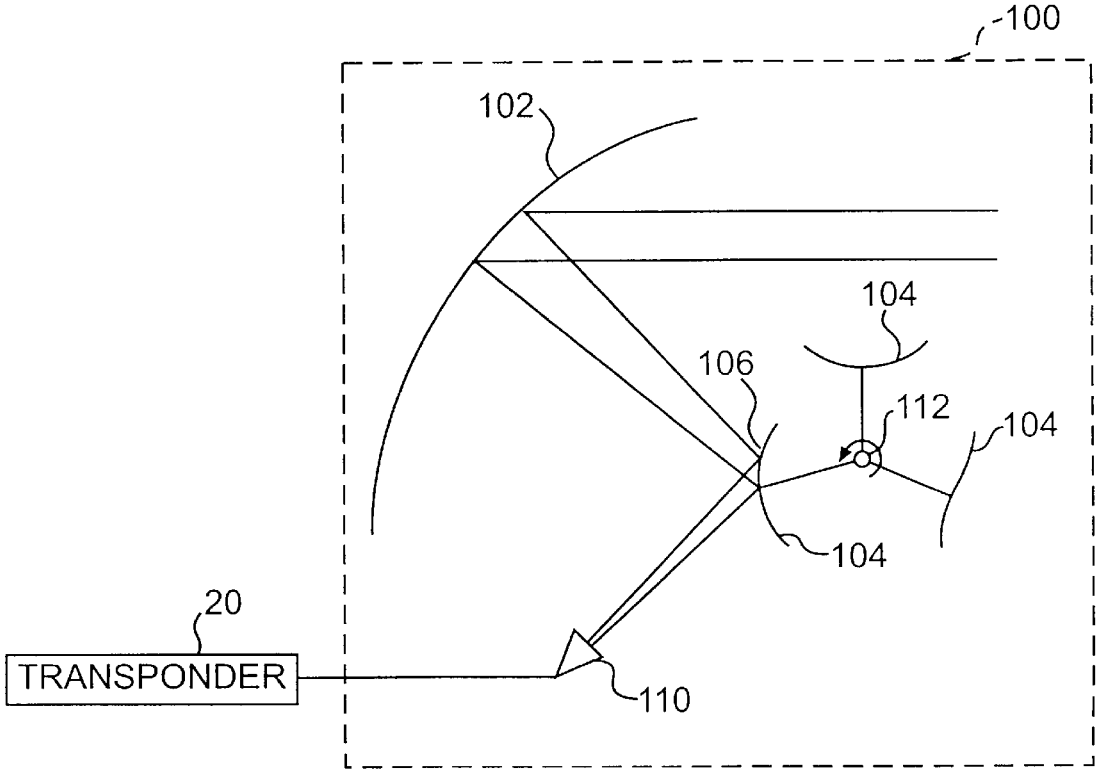
FIG. 4 depicts a configurable, dual-reflector antenna having multiple subreflectors movably disposed relative to the main reflector according to an embodiment of the present invention.

FIG. 4 depicts a configurable beam antenna according to the present invention. The antenna 100 includes a main reflector 102, a plurality of subreflectors 104 and a feed element 110. The main reflector 102 may be an unshaped parabolic mirror in which case it has the appearance of a dish in three dimensions. Alternatively, the main reflector may be a shaped mirror, such as a spherical, hyperbolic, ellipsoid or irregular shape where irregularities are introduced in order to provide a particular beam shape. The main reflector 102 has a reflective surface oriented toward a field of view and the subreflector. The inner surface of the main reflector 102 may be convex or concave.

The plurality of subreflectors 104 are movably disposed relative to the main reflector 102. Each of the plurality of subreflectors 104 may have the same or a different shape in order to produce a different shaped beam. During use of the antenna, at least one of the plurality of subreflectors is an active subreflector 106 and therefore communicates radiation between the main reflector 102 and the feed element 110. Each of the subreflectors 104 may have any convenient shape, including ellipsoid, hyperboloid, paraboloid or irregularly shaped where irregularities are chosen to create a desired beam shape.

In order to configure or re-configure the antenna 100, the active subreflector 106 is moved relative to the main reflector so that it no longer communicates radiation between the main reflector 102 and the feed element 110. Subsequently, a different subreflector 104 is moved relative to the main reflector 102 so that it becomes the active subreflector 106 that communicates radiation between the main reflector 102 and the feed element 110. In a preferred embodiment of the invention each of the subreflectors 104 has a different shape that is chosen, along with the size, shape and distance from the main reflector 102 to produce different beam shapes.

Any technique for movably disposing the subreflectors 104 relative to the main reflector 102 is contemplated. For example, in one embodiment of the invention, three subreflectors 104 are mounted around a common axis of rotation 112 as shown in FIG. 4. A single-axis gimbal may be used as the common-axis of rotation 112 as shown. The gimbal may be driven by a motor coupled thereto which rotates the gimbal in order to change the active subreflector 106. Alternatively, the common axis of rotation 112 may be a shaft of a motor to which the subreflectors 104 are coupled. The coupling may be direct or through a gearing arrangement. Many other techniques may be used. For example, one or more movable arms may be configured to move an appropriate one of a set of subreflectors 104 into the active subreflector 106 position. In this embodiment, one or more subreflectors may be rigidly attached to one or more arms. Alternatively, one or more arms may be configured to release and attach subreflectors in response to commands. In still another embodiment, a track having a movable portion such as a belt, strip or chain to which subreflectors 104 are attached may be used to move appropriate ones of the subreflectors 104 into the active subreflector 106 position.

In any of these embodiments, once the desired subreflector 104 is moved into the active subreflector 106 position, the active subreflector may be locked into position to ensure alignment stability. This may be done in any convenient manner including using a gimbal holding torque which is a well known technique. Alternatives may include spring loaded mechanisms or the resistance to rotation of the motor shaft and gears while in a stationary position.

Figure 5:
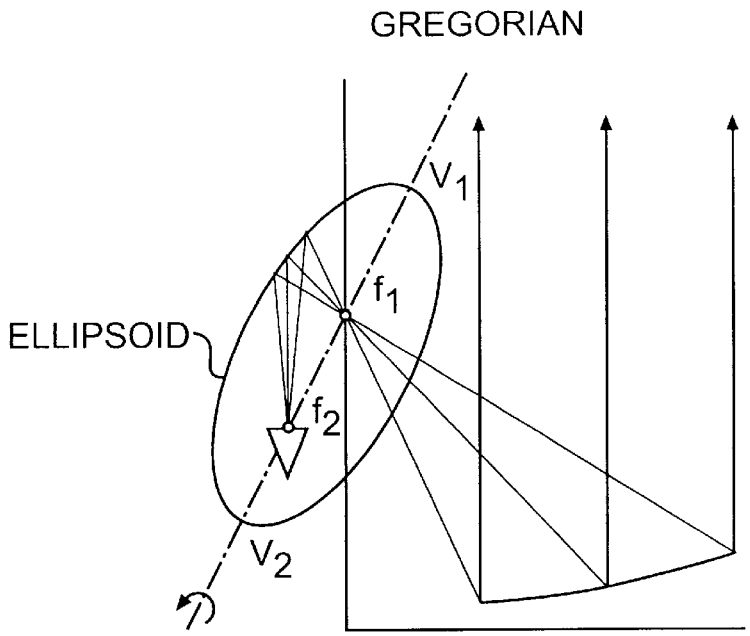
FIG. 5 depicts positioning of the active subreflector in a Gregorian configuration according to the present invention.
Figure 6:
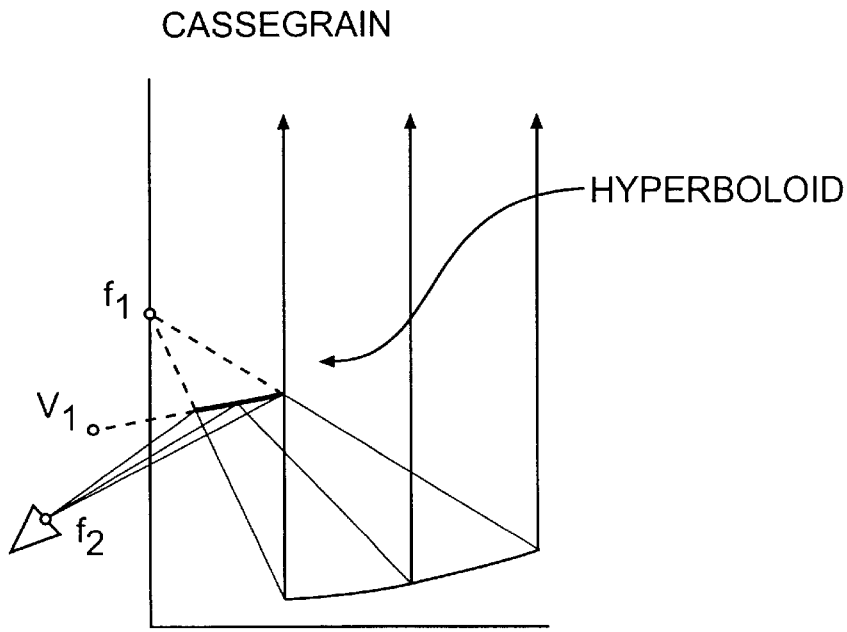
FIG. 6 depicts positioning of the active subreflector in a Cassegrain configuration according to the present invention.

In a preferred embodiment of the invention, positioning of the active subreflector 106 is done to so that one focus of the active subreflector 106 coincides with the focus of the main reflector 12 and so that the other focus of the active reflector 106 coincides with a communicating end of the feed element 110. This is shown in FIG. 5 for the case of Gregorian optics and in FIG. 6 for the case of Cassegrain optics.

Figure 7:
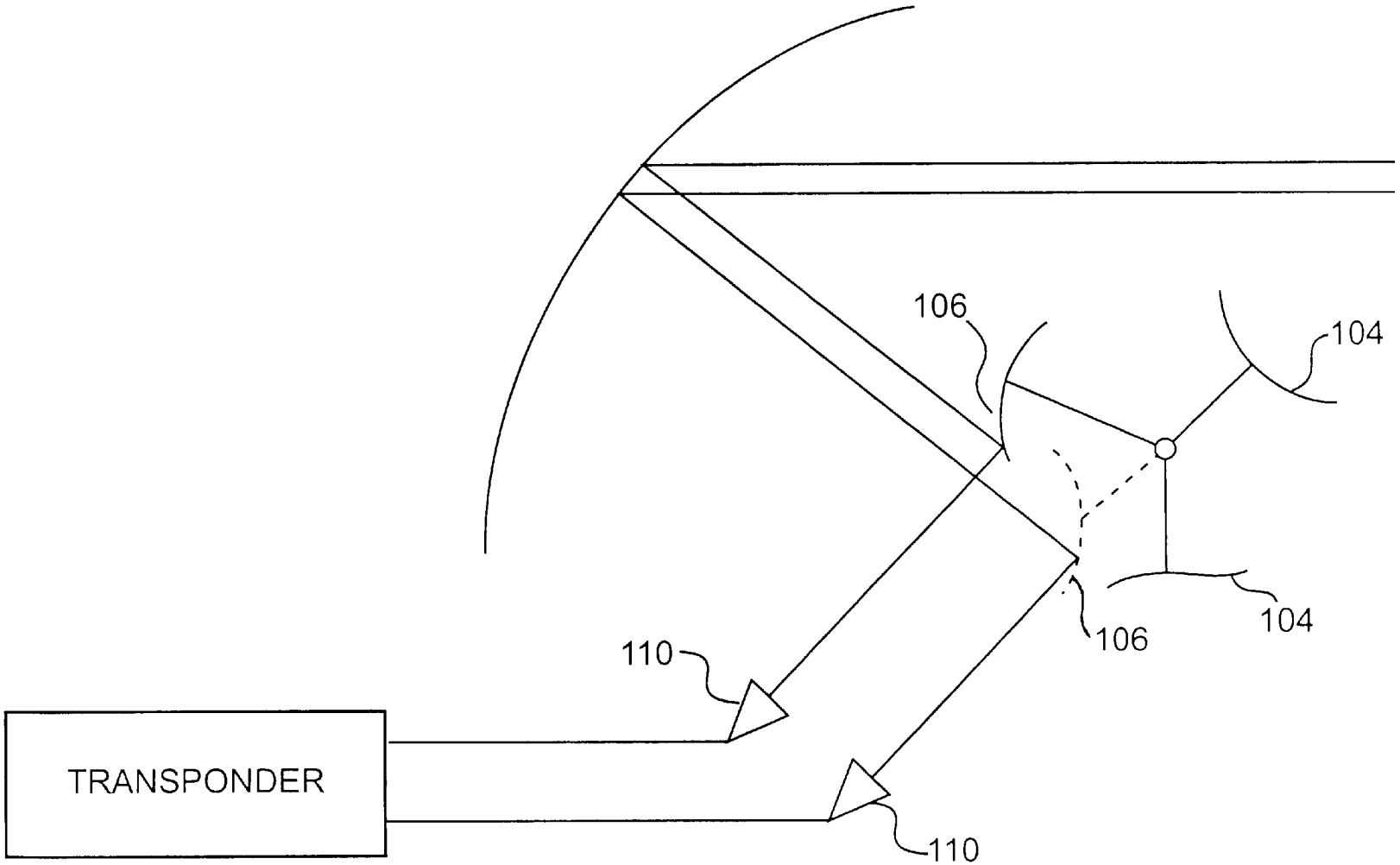
FIG. 7 depicts an antenna configuration having multiple feed elements according to an embodiment of the present invention.

FIG. 7 depicts an alternate embodiment of the invention in which multiple feed elements 110, or a single movable feed element 110, are/is positioned relative to a plurality of configurable subreflectors 104. Each of the plurality of positions for the feed element(s) 110 are chosen so that a communicating end of the desired feed element 110 is at the focus of an active subreflector 106 within the plurality of subreflectors 104. This embodiment may be preferred in order to minimize the motion required to move each subreflector 104 into an active position relative to the main reflector 102 and each feed element 110. The feed element 110 is typically a feed horn. However, the feed element 110 may also be a helix, dipole or microstrip or an array of horns, helices, dipoles or microstrips.

Figure 8:
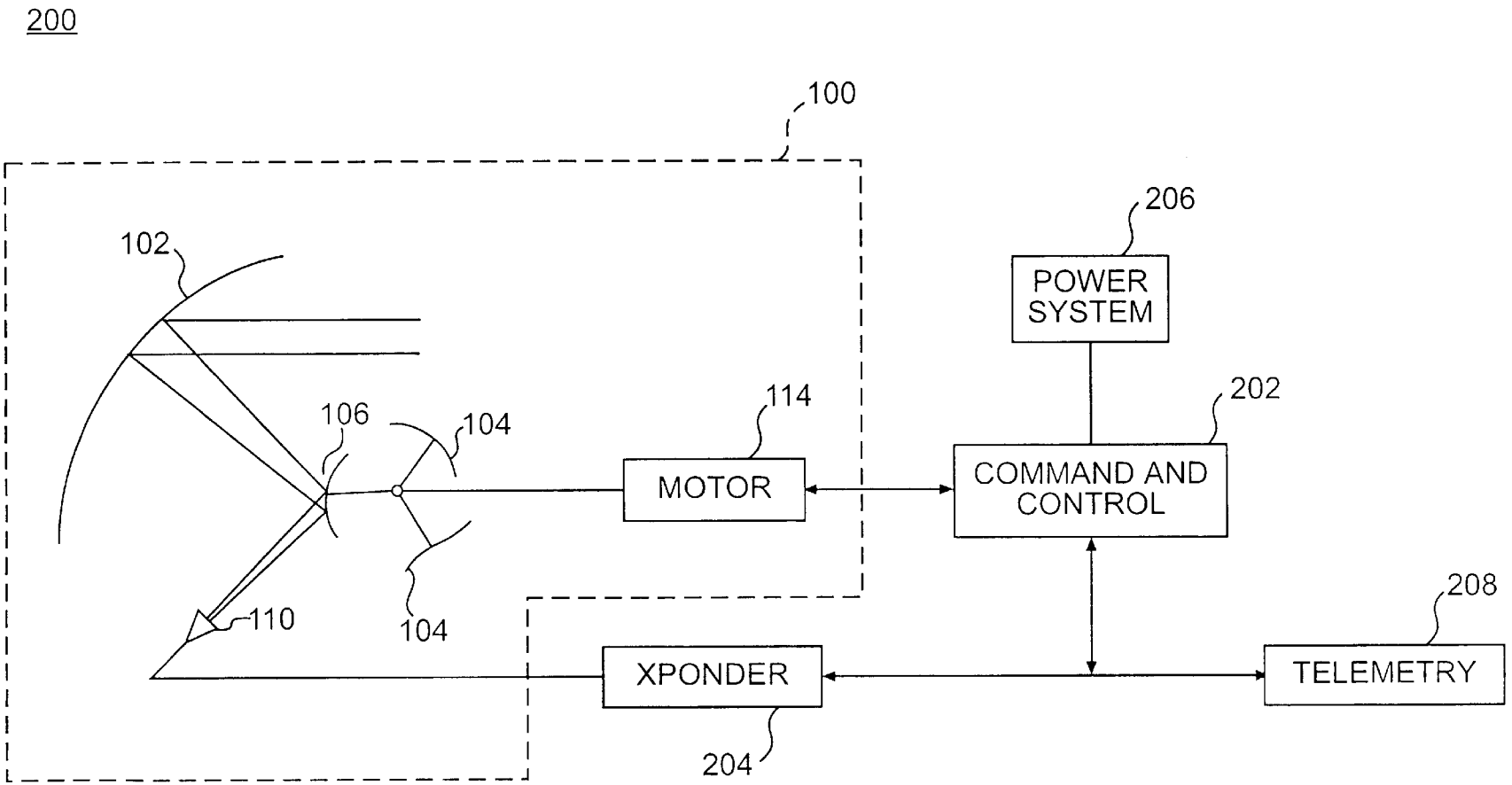
FIG. 8 depicts a functional view of an embodiment of a satellite system including the present invention.

FIG. 8 depicts a functional view of an embodiment of a satellite system 200 incorporating the present invention. The satellite system 200 includes a command and control unit 202 coupled to a transponder 204 and a power system 206 and a telemetry unit 208. The transponder unit 204 is in turn coupled to the configurable antenna 100.

The power system 206, which may include solar arrays, batteries and/or a nuclear power generator, generates, stores and distributes power to all of the units of the satellite. The telemetry unit 208 stabilizes and keeps the satellite 208 and its configurable antenna 210 properly aligned. Stabilization may be accomplished in a well known manner using spin stabilization, three axis stabilization or other techniques including magnetic torque rods.

The command and control unit 202 is essentially a computer and communications system which runs program instructions to carry out the mission of the satellite. The command and control unit 202 may receive and upload instructions to run or commands to execute from a ground station. For example, the command and control unit 202 may receive a command from a ground station to reconfigure the configurable antenna 100 to bring a different subreflector 104 into the active position. In response, the command and control unit 202 may command or control the motor 114 of the antenna 100 to move a desired one of the subreflectors 104 into the active position 106. The result is a change in the shape of the beam transmitted to and received from the field of view of the antenna 100. The motor 114 typically includes a motor control system, well known in the art, that includes a feed back loop with position, velocity, and/or acceleration sensors. The control system receives the commanded position and controls movement of the motor shaft to reach the desired position.

The transponder receives signals for transmission from the command and control unit 202, amplifies the signals and outputs the signals to a communicating end of the feed element 110 for transmission via the reflectors 106 and 102 to the field of view of the antenna 100 in the desired beam pattern. The transponder 204 also may receive signals from the desired beam pattern emanating from the field of view and output those signals to the command and control unit 202 for signal processing or other applications as pursuant to the mission configuration of the satellite system 200.

There are numerous ways of mounting the antenna 100 for use in communications. Any convenient mounting technique may be used. For example the antenna 100 may be a single assembly that is fixedly or configurably mounted to a structure for use in communications. Alternatively, the antenna 100 may be mounted as separate parts to a structure for use in communications, where each of the separate parts may be movably disposed relative to each other or the structure. The structure itself may be disposed on land or may be part of a vehicle such as a satellite, airplane or automobile.

Figure 9:
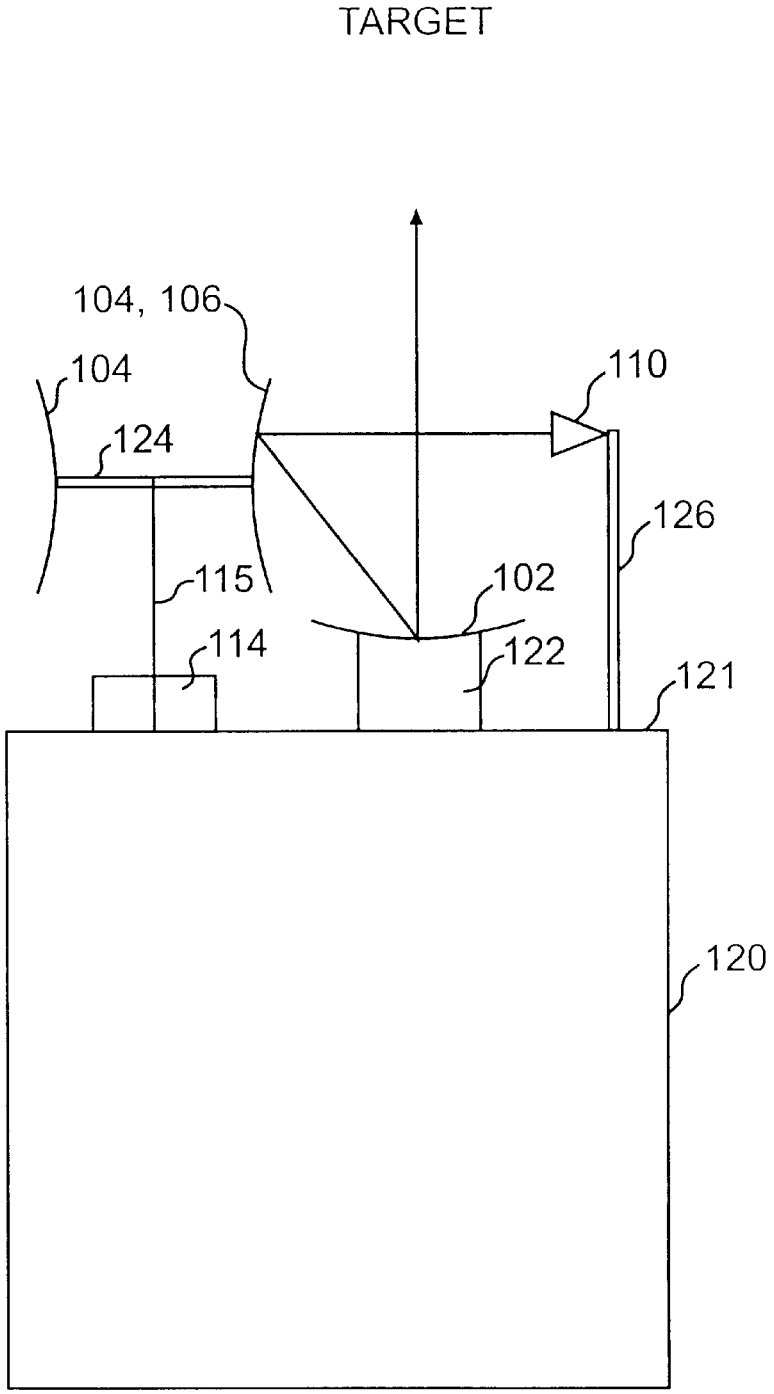
FIG. 9 illustratively depicts a technique for mounting a configurable antenna onto a satellite according to an embodiment of the present invention.

FIG. 9 illustratively depicts a technique for mounting a configurable antenna 100 onto a satellite 120. The satellite 120 has a deck 121 that, during orbit, is oriented generally facing a target, such as the earth. On the deck 121, individual parts of the configurable antenna 100 are mounted. Referring to FIG. 9, the main reflector 102 is mounted to the deck 121 via a support structure 122. The support structure 122 may mount the reflector 102 in a fixed position relative to the deck 121 when the support structure is a rigid member. Alternatively, the support structure may mount the reflector 102 in a movable position relative to the deck 121, such as when the support structure is a single or multiple axis gimbal.

The motor 114 may be mounted to the deck 121 and may include a rotating shaft 115 coupled to a bar 124 at ends of which subreflectors 104 are disposed. The motor 114 may be part of a multiple axis gimbal in which case the shaft 115 may also be movable relative to the deck 121 off of the axis of rotation of the shaft 115.

The feed element 110 is mounted to the deck 121 by the arm 126. The arm may be fixed or movably disposed relative to the deck 121. Each of the parts that participate in the mounting, such as the motor 114, shaft 115, bar 124, support structure 122 and arm 126 are positioned on the deck 121 and relative to each other and to the subreflectors 104, main reflector 102 and the feed element 110 to preserve the geometry of the antenna 100 as described with reference to FIGS. 4–7. Moreover, each of the parts may be secured to each other or the deck 121 (or other part of the satellite 120) in any convenient way, including by welding, bolting, riveting, using adhesives or by being integrally formed.

Figure 10:
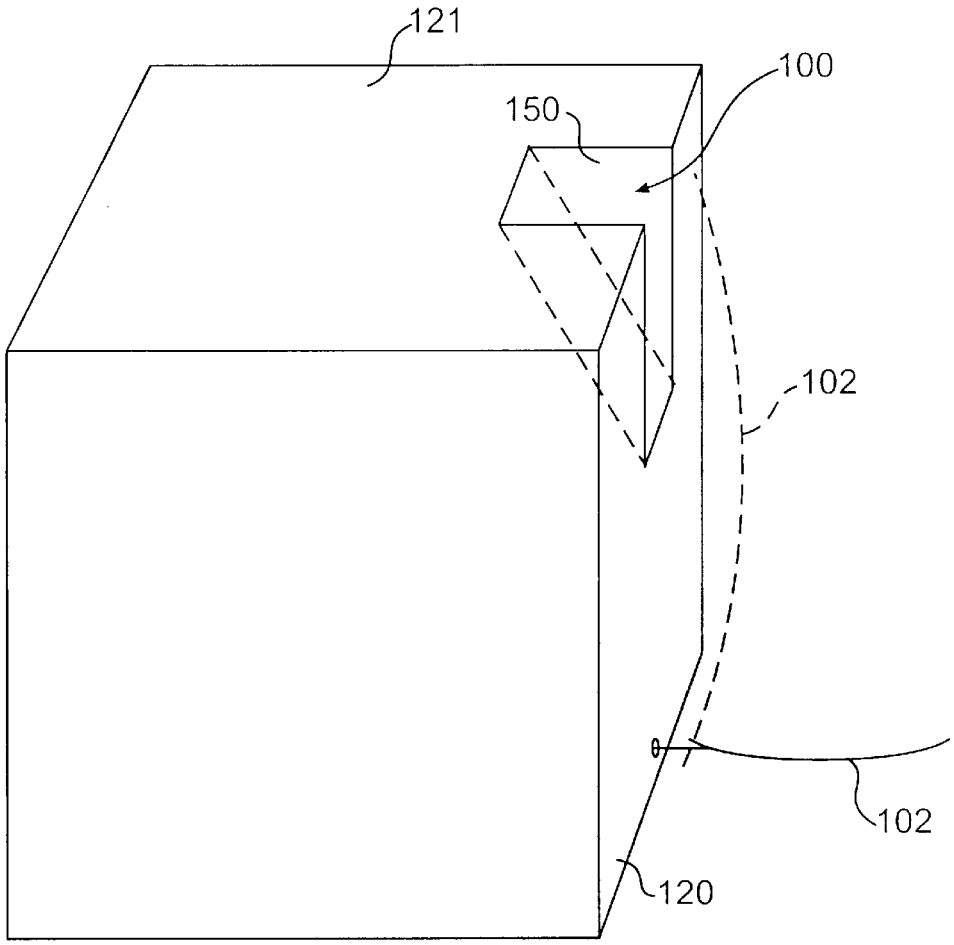
FIG. 10 depicts an alternative mounting technique in which the satellite includes a recess for receiving the configurable antenna.

FIG. 10 depicts an alternative mounting technique in which the satellite 120 includes a recess 150. In the recess 150, all or parts of the antenna 100 may be mounted in any convenient manner. The recess 150 permits the antenna 100 to be mounted in a way that minimizes the volume of the satellite 120 to facilitate launching the satellite 120 on a launch vehicle. When the antenna 100 is mounted in separate parts, the main reflector 102 may be movably mounted, for example, to a face of the satellite 120 as shown such that it may be unfurled for use as depicted in FIG. 10. The mounting of the main reflector to permit unfurling may be accomplished in any convenient manner, including using a gimbal or hinge.

Figure 11:
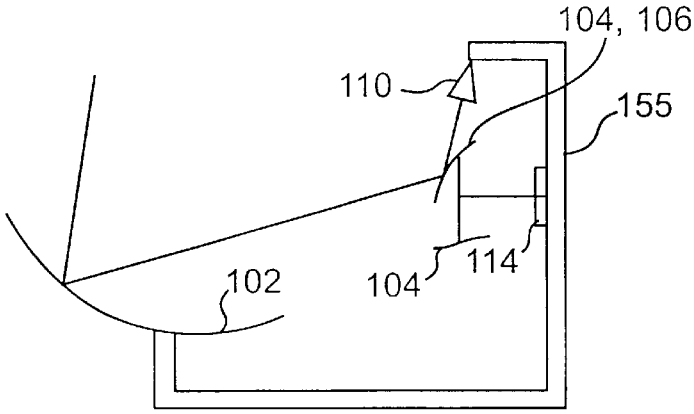
FIG. 11 depicts an embodiment of the configurable antenna as a single assembly according to the present invention.

FIG. 11 depicts an embodiment of the antenna 100 as a single assembly. In this embodiment, the main reflector 102, the motor 114 and the feed element 110 are each mounted to an arm 155. In this arrangement the arm 155 and attachments thereto may be configured in any desired manner consistent with the geometry of the antenna 100 as described with reference to FIGS. 4–7.

Although specific embodiments of the present invention have been disclosed, it will be understood by those having ordinary skill in the art that changes may be made to those embodiments without departing from the spirit and scope of the invention. For example, while embodiments have been described in which the subreflectors are moved and the main reflector remains fixed, the main reflector may be moved, instead or in addition to the movement of the subreflectors, to bring different subreflectors into the active position. The language "moving (configuring or re-configuring) the subreflectors relative to the main reflector . . . " is intended to encompass these variations.

What is claimed is:

1. A configurable antenna, comprising:

a main reflector;

a feed element; and at least two subreflectors, each of the subreflectors being configurably disposed relative to the main reflector to provide a selected active subreflector, among the at least two subreflectors, for reflecting radiation between the main reflector and the feed element in a desired beam;

wherein the selected active subreflector changes based on a configuration of the antenna.

2. The antenna according to claim 1, wherein the feed element is a horn.

3. The antenna according to claim 1, wherein the feed element is a helix.

4. The antenna according to claim 1, wherein each of the subreflectors has a different shape.

5. The antenna according to claim 1, further comprising:

a single axis gimbal for mounting the subreflectors to a satellite; and a motor, coupled to the gimbal and a satellite, for rotating the subreflectors about the single axis to change the configuration of the antenna.

6. The antenna according to claim 1, wherein the main reflector is shaped to provide a desired beam.

7. The antenna according to claim 1, further comprising a motor rigidly disposed relative to the main reflector, the motor including a rotatable shaft coupled to the at least two subreflectors, the motor rotating the shaft to urge the at least two subreflectors into desired configurations.

8. A method of providing a configurable beam antenna, comprising the steps of:

providing a main reflector;

providing a feed element;

providing at least two subreflectors, each of the subreflectors being configurably disposed relative to the main reflector to provide a selected active subreflector, among the at least two subreflectors, for reflecting radiation between the main reflector and the feed element;

wherein the selected active subreflector changes based on a configuration of the antenna.

9. The method according to claim 8, wherein the feed element is a horn.

10. The method according to claim 8, wherein the feed element is a helix.

11. The method according to claim 8, further comprising the step of:

mounting the main reflector to a satellite system.

12. A configurable, satellite-based communications system comprising:

a main reflector disposed on a satellite;

a feed element; and at least two subreflectors, each of the subreflectors being configurably disposed relative to the main reflector to provide a selected active subreflector, among the at least two subreflectors, for reflecting radiation between the main reflector and the feed element;

wherein the selected active subreflector changes based on a configuration of the antenna.

13. The configurable communications system according to claim 12, further comprising:

a transponder for transmitting signals to and receiving signals from a second communicating end of the feed element.

14. The configurable communications system according to claim 12, wherein the feed element is a horn.

15. The configurable communications system according to claim 12, wherein the feed element is a helix.

16. The configurable communications system according to claim 12, further comprising a motor rigidly disposed relative to the main reflector, the motor including a rotatable shaft coupled to the at least two subreflectors, the motor rotating the shaft to urge the at least two subreflectors into desired configurations.

17. The configurable communications system according to claim 12, further comprising:

a transponder for transmitting signals to and receiving signals from a second communicating end of the feed element;

a motor rigidly disposed relative to the main reflector, the motor including a rotatable shaft coupled to the at least two subreflectors, the motor rotating the shaft to urge the at least two subreflectors into desired configurations; and a command and control unit, coupled to the transponder and the motor, for commanding the motor to change the desired configurations and for controlling the transponder.

* * * * *